US007740930B2

(12) United States Patent
Shortland et al.

(10) Patent No.: US 7,740,930 B2
(45) Date of Patent: Jun. 22, 2010

(54) STAIN-RESISTANT FLOORING MATERIAL

(75) Inventors: Adrian John Shortland, Birmingham (GB); Karen Alexandra Masters, Hertfordshire (GB)

(73) Assignee: Autoglym, Hertfordshire (GB)

( * ) Notice: Subject to any disclaimer, the term of this patent is extended or adjusted under 35 U.S.C. 154(b) by 189 days.

(21) Appl. No.: 10/483,851

(22) PCT Filed: Jul. 30, 2002

(86) PCT No.: PCT/GB02/03467

§ 371 (c)(1),
(2), (4) Date: Jul. 6, 2004

(87) PCT Pub. No.: WO03/012191

PCT Pub. Date: Feb. 13, 2003

(65) Prior Publication Data

US 2005/0003157 A1 Jan. 6, 2005

(30) Foreign Application Priority Data

Jul. 31, 2001 (GB) ..... 0118567.7

(51) Int. Cl.
*B32B 5/12* (2006.01)

(52) U.S. Cl. ..... 428/149; 428/143

(58) Field of Classification Search ..... 428/149, 428/143

See application file for complete search history.

(56) References Cited

U.S. PATENT DOCUMENTS

| | | | |
|---|---|---|---|
| 2,010,025 | A | 8/1935 | Kirchner et al. |
| 2,793,136 | A | 5/1957 | Root |
| 3,030,251 | A | 4/1962 | La Bore et al. |
| 3,267,187 | A | 8/1966 | Slosberg et al. |
| 3,310,619 | A | 3/1967 | Slosberg |
| 3,565,661 | A | 2/1971 | Harrison ..... 117/9 |
| 3,585,099 | A | 6/1971 | Buskirk |
| 4,196,243 | A | 4/1980 | Sachs et al. |
| 4,239,797 | A | 12/1980 | Sachs |
| 4,243,696 | A | 1/1981 | Toth |
| 4,348,447 | A | 9/1982 | Miller, Jr. et al. |
| 4,405,657 | A | 9/1983 | Miller, Jr. et al. |
| 4,501,783 | A | 2/1985 | Hiragami et al. |
| 4,528,231 | A | 7/1985 | Lund |
| 4,882,205 | A | 11/1989 | Valenduc |
| 4,961,980 | A | 10/1990 | Valenduc |
| 4,965,299 | A | 10/1990 | Timm et al. |
| 5,229,460 | A | 7/1993 | Yousuf et al. |
| 5,358,993 | A | 10/1994 | Timm et al. |

(Continued)

FOREIGN PATENT DOCUMENTS

| | | |
|---|---|---|
| DE | 4120884 | 2/1992 |

(Continued)

*Primary Examiner*—William P Watkins, III
(74) *Attorney, Agent, or Firm*—Mark A. Litman & Associates, P.A.

(57) ABSTRACT

The present invention provides a flooring material including a base portion, a coating portion being positioned in contact with an upper surface of the base portion and creating an upper surface of the flooring material, wherein the coating portion is substantially free from contaminants from the base portion which decrease the stain resistance of the coating portion and wherein the coating portion includes a first particulate material which at least partially penetrates the base portion and is proud from the upper surface of the flooring material.

5 Claims, 1 Drawing Sheet

U.S. PATENT DOCUMENTS

Figure 1:
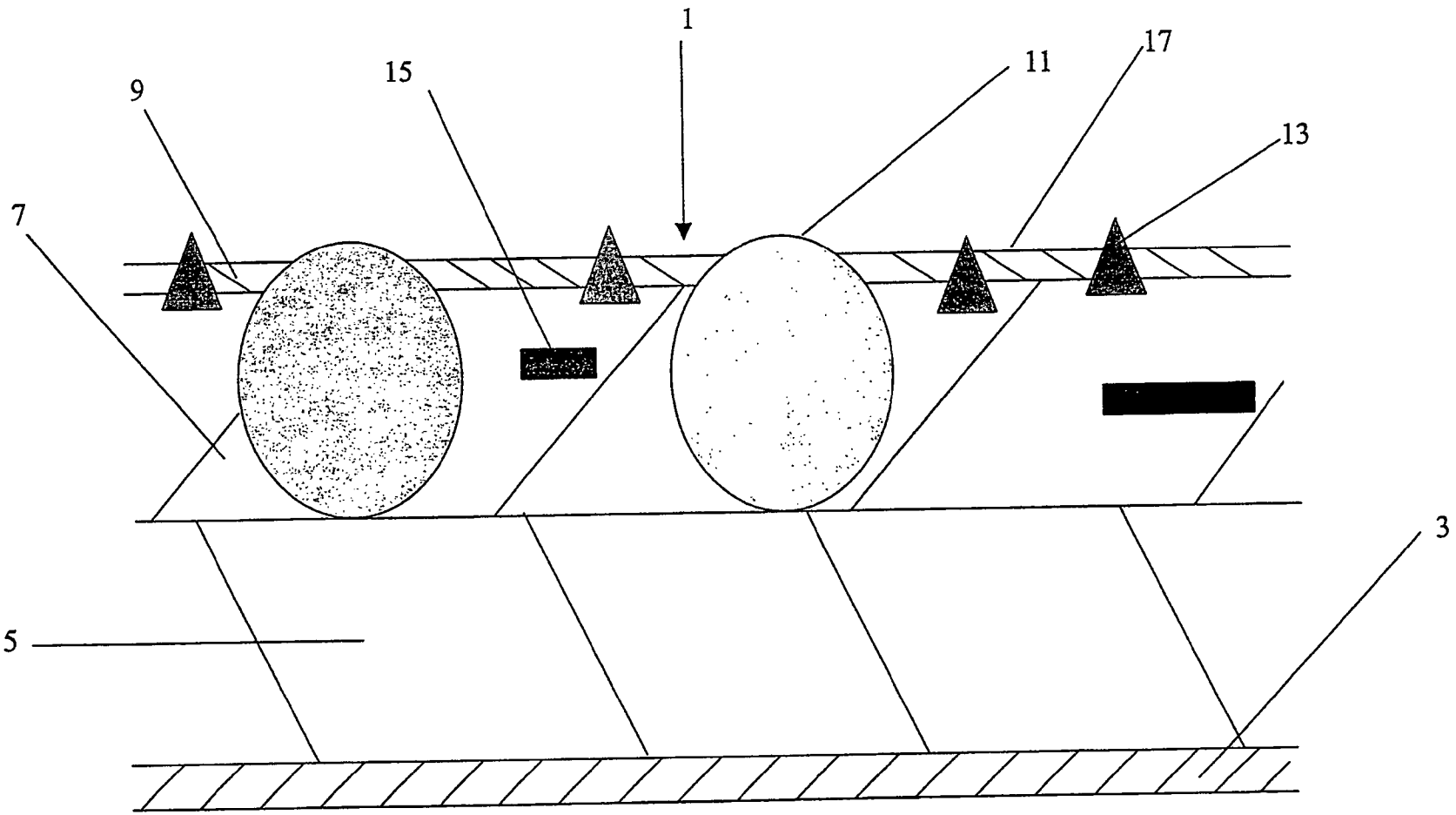

| | | | | |
|---|---|---|---|---|
| 5,475,951 | A | 12/1995 | Litzow | |
| 5,627,231 | A | 5/1997 | Shalov et al. | |
| 5,763,070 | A | 6/1998 | Kerlek et al. | |
| 5,787,655 | A | 8/1998 | Saylor, Jr. | |
| 5,830,937 | A | 11/1998 | Shalov et al. | |
| 5,965,198 | A | 10/1999 | Plusquellec et al. | |
| 6,132,844 | A * | 10/2000 | Altshuler et al. | 428/143 |
| 6,364,946 | B2 | 4/2002 | Staeblein et al. | 117/81 |
| 6,730,388 | B2 * | 5/2004 | MacQueen et al. | 428/141 |
| 2001/0025598 | A1 | 10/2001 | Staeblein et al. | |
| 2001/0028945 | A1 | 10/2001 | Chen et al. | |
| 2003/0089306 | A1 | 5/2003 | Speit et al. | |

FOREIGN PATENT DOCUMENTS

| | | |
|---|---|---|
| EP | 217989 | 4/1987 |
| EP | 494658 | 7/1992 |
| EP | 552698 | 7/1993 |
| EP | 703284 | 3/1996 |
| GB | 2038710 | 7/1980 |
| JP | 2300390 | 12/1990 |
| WO | 9939042 | 8/1999 |
| WO | 0022225 | 4/2000 |
| WO | 0042274 | 7/2000 |
| WO | 0164977 | 9/2001 |

* cited by examiner

STAIN-RESISTANT FLOORING MATERIAL

The present invention relates to the treatment of flooring to improve stain resistance and to lower the rate of dirt pick up. In particular it relates to flooring with enhanced slip resistance and especially PVC flooring with enhanced slip resistance treated to improve stain resistance and to lower the rate of dirt pick up and to a method of manufacturing such flooring.

The problems of staining and dirt pick up occur with many flooring materials but is particularly acute with synthetic flooring provided with a non-slip finish. The roughened non-slip finish tends to accumulate dirt in its crevices which increases the likelihood of stains in the flooring material.

In the past, it has been attempted to improve the stain resistance of flooring by applying a coating layer, for example by a powder coating process. However this improvement has not provided a long term solution to the problem and has been found to lead to a greater rate of dirt pick up compared to a non-coated flooring material. Accordingly a new way of improving the stain resistance and lowering the dirt pick up rate of flooring materials has been sought.

The present invention provides a flooring material including a base portion, a coating portion being positioned in contact with an upper surface of the base portion and creating an upper surface of the flooring material, wherein the coating portion is substantially free from contaminants from the base portion which decrease the stain resistance of the coating portion and wherein the coating portion includes a first particulate material which at least partially penetrates the base portion and is proud from the upper surface of the flooring material.

The contaminants from which the coating portion is substantially free are preferably contaminants which are capable of diffusing from the base portion into the coating portion of the flooring material, particularly during manufacture of the flooring material. The contaminants are more preferably diffusable liquids. Examples of contaminants include a plasticiser, a thermal stabiliser, a rheology or viscosity modifier, and/or a carrier liquid for an additive to the base portion. Examples of plasticisers include di-isodecyl phthalate (e.g. Jayflex DIDP manufactured by Exxon), di-isononyl phthalate (e.g. Jayflex DINP manufactured by Exxon), di-octyl phthalate, alkyldiaryl phosphates, di-isononyl adipate and/or chlorinated paraffin. Examples of thermal stabilisers include a barium-zinc soap, a calcium-zinc soap, and/or tin maleate; examples of commercial thermal stabiliser products include Irgastab BZ505 (made by Witco) and Barostab BZ113 (manufactured by Baerlocher). Examples of rheology or viscosity modifiers include white spirit and low volatility alcohol ethoxylates; an example of a commercial viscosity depressant is Viscobyk 5050 (manufactured by Byk-Chemie). An example of a carrier liquid for an additive is an epoxidised soya bean oil in which a biocide may be dispersed (e.g. ABF2 ESBO manufactured by Ackros).

It has been found that by providing a coating portion which is substantially free from contaminants from the base portion, a flooring material having improved stain resistance and a lower rate of dirt pick up is obtained.

In the coating portion of the flooring material according to the invention, there are generally substantially no contaminants from the base portion such that interpenetration between the base portion and the coating portion is minimised. Preferably there is only interpenetration between the base portion and the coating portion to the extent necessary to bond the two portions together.

Preferably the flooring material is a plastics flooring material. The coating portion preferably includes a thermoplastic or a cross-linkable polymer or copolymer. For the cross-linkable polymer or copolymer, cross-linking may be effected by condensation or by a free radical route such as using UV radiation. Examples of suitable polymers or copolymers include PvdF, a polyester, polyurethane, or acrylic polymer or copolymer, an epoxy resin, and/or an olefin/modified olefin copolymer. More preferably the coating portion includes an acrylic polymer. Most preferably the coating portion includes a mixture of an acrylic polymer with PvdF. Preferably the coating portion is substantially free from a thermosetting polymer or co-polymer. This is because thermosetting polymers or copolymers are not generally sufficiently fast curing or flexible enough to be useful in the coating portion of the flooring material.

Optionally the coating portion further includes additives commonly used in the art such as a UV stabiliser, a biocide, and/or a flow aid such as fumed silica.

Advantages of the first particulate material being embedded in the coating portion include that the flooring material is a non-slip flooring material and that the wear resistance of the coating is increased. Advantages of having the first particulate material partially penetrating the base portion include that it is less likely to become dislodged. Thus the life of the non-slip properties of the flooring material is prolonged.

The advantages of having the first particulate material at least partially proud from the upper surface of the flooring material include that the wear resistance and slip resistance of the flooring material are improved.

The flooring material is preferably a plastics flooring material, more preferably the base portion and the coating portion are formed from the same or different plastics materials, preferably different plastics materials.

Preferably the base portion includes PVC, a polyurethane, an epoxy resin, a plasticised acrylic, and/or a polyester. More preferably, the base portion includes a plastics material such as a PVC plastisol or a plasticised acrylic material.

The base portion preferably includes a second particulate material dispersed therein to further improve the non-slip properties of the flooring material or to enhance the wear resistance of the flooring material. The base portion may optionally contain decorative elements such as a pigment and/or PVC chips. The base portion preferably includes a reinforcing support; the support is preferably a glass fibre reinforced non-woven support.

The base portion may be made up of one or more layers of plastics material; preferably up to three layers are envisaged.

The first and/or second particulate material is preferably a grit; more preferably it is one or more of a number of types of hard particles including silicon carbide, a silica (e.g. quartz, a coloured or natural sand or a flint), aluminium oxide and/or emery.

The base portion and/or the coating portion of the flooring material may optionally further contain quartz chips or other decorative additives to add a decorative effect to the flooring material. The base portion may also optionally contain pigmented PVC chips.

Preferably the flooring material is embossed.

The present invention further provides a method of making a flooring material, the method including the steps of:

a) applying a base layer on a surface of a support;

b) increasing the viscosity of the base layer;

c) applying a coating layer on the base layer; and d) heating the layers.

According to the invention there is also provided a flooring material obtainable by the method of the present invention.

By increasing the viscosity of the base layer in step (b), prior to the application of the coating layer, subsequent transfer of contaminants from the base layer into the coating layer is restricted resulting in improved stain resistance and a lower rate of dirt pick up in the flooring material.

One advantage of step (b) of the method of the invention is that when step (d) of the method of the invention is carried out, interpenetration of the coating layer and the base layer is optimised such that interpenetration is sufficient to ensure that the coating layer is fully adhered to the base layer without the characteristics of the coating layer being compromised, for example by the diffusion of contaminants from the base layer into the coating layer.

It has been found that existing flooring material products, which include a base layer and a coating layer and which have been made by a process which omits step (b) have components from the base layer present at the surface of the coating layer. Thus in such products interpenetration of the coating layer and the base layer is complete.

It has also been found that where instead of step (b), the base layer is completely cured or gelled, the adhesion between the base and coating layers is not good and that, depending on the nature of the components of the base layer, the coating layer may be liable to peel off the base layer.

Generally the components of the base layer used in step (a) of the method of the invention are in the form of a paste or liquid when mixed. Generally they include a polymer, a plasticiser, a thermal stabiliser, a rheology or viscosity modifier, and/or a biocide.

The support used in step (a) of the method according to the invention is preferably an integral part of the flooring material. More preferably the support includes a reinforcing support; most preferably the support is a glass fibre reinforced non-woven support. Optionally the support is pre-coated with one or more base layers.

Where the support is not an integral part of the flooring material and provides a substrate on which the method of the invention can take place, the support is preferably arranged such that the flooring material can be removed from it after the method of the invention has been completed.

The base layer is preferably applied to the support by spreading, more preferably at a controlled thickness, e.g. by using a blade.

Preferably the base layer includes PVC, a polyurethane, an epoxy resin, a plasticised acrylic, and/or a polyester. More preferably, the base layer includes a plastics material such as a PVC plastisol or plasticised acrylic material. The base layer may optionally contain a pigment. A particulate material may be included in the base layer and/or a coating of particulate material may be applied to the base layer before step (b) to confer further slip and wear resistance and give some aesthetic properties. It is important that the particulate material is applied before the viscosity of the base layer is increased so that the upper surface of the base layer solidifies. This is in order to prevent the particulate material bouncing and forming agglomerates on the surface of the base layer.

Preferably a layer of particulate material is applied to the base layer immediately before step (b). The advantage of such a step is that if step (b) immediately follows the application of the particulate material, then at least some of the particles of the particulate material will stay proud of the surface of the base layer. In other words, not all of the particles of the particulate material will have time to sink into the base layer such that the base layer wholly encloses them. As a result, when the coating layer is applied, at least some of the particulate material should remain proud of the coating layer (depending on the size and shape of the particles of the particulate material and the thickness of the coating layer). This should be enough to ensure adequate slip resistance in the flooring material.

The particulate material is preferably a grit; more preferably it is one or more of a number of types of hard particles including silicon carbide, a silica (e.g. quartz, a coloured or natural sand or a flint), aluminium oxide and/or emery.

A variety of particles or chips such as PVC chip particles or coloured quartz particles may be added to the base layer spread at controlled thickness by, for example, sprinkling the particles from above.

Optionally more than one application of the particulate material may be made. For example, particulate material may optionally be applied to the base layer at the same time as the coating layer. Additionally, an application of particulate material may optionally be made after the coating layer is applied to the base layer.

In step (b) the viscosity of the base layer needs to be increased such that there are not enough contaminants present at the surface of the base layer to diffuse into the coating layer. On the other hand, the viscosity of the base layer is preferably not increased so much that when the flooring material is cured, there is poor adhesion between the base layer and the coating layer. A balance between these two properties can easily be found by a person of skill in the art by trial and error.

In step (b), the viscosity of the base layer is preferably increased by irradiating the base layer with an infrared heater. Optionally in step (b) the surface of the base layer is at least partially gelled or the surface is completely gelled.

The coating layer is preferably applied in the form of a powder layer. More preferably the coating layer includes a thermoplastic or a cross-linkable polymer or copolymer. For the cross-linkable polymer or copolymer, crosslinking may be effected by condensation or by a free radical route such as using UV radiation. Examples of suitable polymers or copolymers include PvdF, a polyester, polyurethane or acrylic polymer or copolymer, an epoxy resin, and/or an olefin/modified olefin copolymer. More preferably the coating layer includes an acrylic polymer. Most preferably the coating layer includes a mixture of an acrylic polymer with PvdF.

Optionally the coating layer further includes additives commonly used in the art such as a UV stabiliser, a biocide, and/or fumed silica.

The components of the coating layer when it is in powder form are optionally applied by a sprinkle system, a roller pick-up/brush off type system or a spray system. Optionally more than one application of the coating layer may be applied.

The presence of the coating layer is likely to reduce water absorption of the flooring material of the present invention. Also the effect of the presence of the coating layer to reduce the amount of volatile organic compounds (VOCs) given off is enhanced because the transfer of VOCs from the base layer to the coating layer is inhibited because of the effect of increasing the viscosity of the base layer in step (b) of the method of the invention.

Where the polymer or copolymer used in the coating layer is cross-linkable and the cross-linking is effected by a free radical route using UV radiation, the method of the invention further includes irradiating the flooring material with UV radiation before or after the heating step.

Preferably the method of the invention includes the further step of embossing the flooring material after step (d). Where UV radiation is used, embossing can take place before or after irradiation but is preferably before. Embossing preferably takes place while the product is still hot and soft after curing and involves the application of pressure, preferably by means of a roller. An advantage of including an embossing step in the method of the invention is that if there is an application of particulate material after step (b), the application of pressure in the embossing step will force that particulate material to penetrate through the coating layer into the base layer.

In tests it has been found that the coating portion of flooring material according to the invention had a third of the contaminants of a comparative flooring material prepared by a method which does not comprise step (b) of increasing the viscosity of the base portion.

The invention will now be described with reference to the following drawing which is not intended to limit the scope of the invention:

FIG. 1 shows a schematic cross-section of a flooring material according to the invention.

The flooring material 1 illustrated in FIG. 1 includes a substrate 3 which is a cellulose/polyester support (Dexter 555:030) reinforced with a Kirson "5×5" 32 tex glass crennette. The substrate 3 is approximately 0.15 mm in thickness. On top of the substrate 3 there is a PVC plastisol undercoat 5 which is approximately 1 mm thick. On top of the undercoat 5 there is a base layer 7 of PVC plastisol which is about 0.8 mm thick. Embedded within the base layer 7 there are particles of coloured quartz 11. On top of base layer 7 there is coating layer 9 which is of a thermoplastic polymer blend including acrylic and PvdF polymers and is about 0.1 mm in thickness. Embedded in and proud of the coating layer 9 and penetrating to the base layer 7 are particles 13 of silicon carbide. Coating layer 9 forms an upper surface 15 of the flooring material 1.

The invention is further illustrated with reference to the following examples which are not intended to limit the scope of the invention claimed.

PREPARATIVE EXAMPLE 1

Plastisols typically having the formulations given in Table 1 were produced as described below.

TABLE 1

Plastisol Formulations

| | A. Weight/kg | B. Weight/kg |
|---|---|---|
| Solvic 380NS | 15 | 20 |
| Solvic 266SF | 5 | — |
| Jayflex DIDP | 6.5 | 6.5 |
| Microdol H155 | 10 | 5 |
| Viscobyk 4040 | — | 0.4 |
| BZ505 | 0.3 | 0.4 |
| ABF2 ESBO | 0.2 | 0.2 |
| Blue BLP pigment | 0.02 | 0.02 |

Wherein Solvic 380NS and Solvic 266SF are PVC polymers manufactured by Solvay; Jayflex DIDP is a di-isodecyl phthalate plasticiser manufactured by Exxon; Microdol H155 is a calcium magnesium carbonate manufactured by Omya; Viscobyk 4040 is a blend of aliphatic hydrocarbons with a neutral wetting and dispersing component manufactured by BYK Chemie; BZ505 is a liquid barium zinc preparation containing organic barium compounds and phosphite manufactured by Witco; ABF2 ESBO is a solution of 10,10'oxybisphenoxyarsine in epoxidised soya bean oil manufactured by Akeros Chemicals; Blue BLP pigment is a phthalocyanine blue pigment manufactured by Ciba Pigments.

In each case, the ingredients were weighed in to a 50 liter steel vessel and mixed by a Zanelli MLV/50 mixer using a trifoil shaft at 100 rpm for 4 minutes and a dissolver shaft at 1800 rpm for 2 minutes. Aluminium oxide particles (from Washington Mills) size F40 (FEPA Standard 42-GB-1984 measurement) were weighed into each plastisol (10% w/w) and mixed.

In the case of plastisol B, this plastisol was also used to make PVC chip by spreading a sample of this plastisol at 0.6 mm using 'knife over bed' on to a siliconized release paper and fusing it for 2 minutes at 180° C. This material was then removed from the release paper and passed through a TRIA granulator (model no. 40-16/TC-SL) fitted with a 2 mm screen to produce PVC chips of B of nominal size 2 mm and thickness 0.6 mm.

PREPARATIVE EXAMPLE 2

Powder coatings C, D and E comprising the ingredients given in Table 2 were produced as described below.

TABLE 2

Powder Coating Formulations C, D and E

| | C. Weight/kg | D. Weight/kg | E. Weight/kg |
|---|---|---|---|
| Uralac P2200 | 10 | — | — |
| Epikote 1055 | — | 10 | — |
| Uvecoat 2000 | — | — | 10 |
| Araldite PT810 | 1.1 | — | — |
| Epikure 108FF | — | 0.45 | — |
| Irgacure 651 | — | — | 0.25 |
| Byk 362P | 0.17 | 0.1 | — |
| Benzoin | 0.08 | — | 0.05 |

Uralac P2200 is a saturated, carboxylated polyester resin manufactured by DSM. Epikote 1055 is an epoxy resin manufactured by Shell Chemicals. Uvecoat 2000 is a polyester resin containing (meth)acrylic double bonds manufactured by UCB Chemicals, Belgium. Araldite PT810 is a triglycidylisocyanurate product manufactured by Ciba Geigy. Epikure 108FF is a dicyandiamide curing agent manufactured by Shell Chemicals. Irgacure 651 is a benzylketal manufactured by Ciba Geigy. Benzoin was obtained from Aldrich Chemicals.

Polyester based coating C was prepared as follows. The ingredients were weighed, and then blended by being tumbled together. The blend was then passed into a Buss Ko-Kneader PLK 46 extruder (barrel temperature 120° C.; screw temperature 50° C.; screw speed 60 rpm). The extrudate was cooled, crushed and sieved to a particle size not exceeding 100 μm.

Epoxy resin D was prepared as follows. The ingredients were weighed, and then blended by being tumbled together. The blend was then passed into a Buss Ko-Kneader PLK 46 extruder (barrel temperature 85° C.; screw temperature 85° C.; screw speed 52 rpm). The extrudate was cooled, crushed and sieved to a particle size not exceeding 100 μm.

Radiation cured polyester coating E was prepared as follows. The ingredients were weighed, and then blended by being tumbled together. The blend was then passed into a Buss Ko-Kneader PLK 46 extruder (barrel temperature 80° C.; screw temperature 80° C.; screw speed 250 rpm). The extrudate was cooled, crushed in a cutting mill and then finely ground in a pin mill before being sieved to a particle size not exceeding 100 μm.

PREPARATIVE EXAMPLE 3

A thermoplastic powder coating F having the formulation shown in Table 3 was produced as described below.

TABLE 3

| Powder Coating Formulation F | |
|---|---|
| | Weight/kg |
| Kynar 500PC | 10 |
| Acryloid B-44 | 4.8 |
| Kynar ADS | 1.1 |
| Irganox 1010 | 0.05 |

Kynar 500PC is a poly(vinylidene)fluoride polymer manufactured by Elf Atochem. Kynar ADS is a low melting point fluorine-based terpolymer also manufactured by Elf Atochem. Acryloid B-44 is a methyl methacrylate/ethyl acrylate copolymer manufactured by Rohm & Haas. Irganox 1010 is an anti-oxidant manufactured by Ciba Geigy.

The ingredients were weighed and blended by being tumbled together. The blend was extruded in a Werner and Pfleiderer extruder (Model ZSK-70) with the screw rotation set at 313 rpm, the barrel set at 200° C. and the feed zone set at 30° C. The extrudate was collected in large containers (of dimensions: 380 mm×305 mm×75 mm) and allowed to cool slowly at ambient temperature for 8 hours. The resulting blocks were broken into smaller pieces by mechanical attrition. The material was then ground in an Alpine Pin disc mill, using a single pass and no intermediate sieving screen. The temperature of the material prior to its introduction into the mill was −100° C.; the mill was maintained at −35° C. during grinding. 99% of the resulting powder was of a size of below 90 microns and the average powder size was 37 μm.

EXAMPLE 4

Plastisol A was spread coated onto a substrate to a thickness of 2 mm by knife over roller. The substrate was a 2 m width cellulose/polyester support (Dexter 555:030) reinforced with a Kirson '5×5' 68 tex glass crennette, moving at a rate of 5 m/minute. Particles of coloured quartz of a size of 1.2-1.8 mm were then scattered onto the surface of the plastisol at a rate of 300 $gm^{-2}$. The coated web was then passed under a 50 kW medium wave infra red heater (width 2.5 m; length 1 m). The heater was positioned at a height of 10 cm above the web. The power output of the heater was adjusted so that the surface of the plastisol as it exited the infra red zone was just solidified (gelled) to the touch.

Polyester based powder coating C, (average particle size 50 μm) was then applied to the surface at a rate of 80±30 $g/m^2$ using a scatter powder coating application system. Particles of silicon carbide size F40 (FEPA Standard 42-GB-1984 measurement) were then scattered on to the surface at a rate of 100 $g/m^2$. The system was then passed in to a convection oven where it was exposed to 195° C. for 2.5 minutes before being embossed, cooled and wound up for subsequent trimming to size.

EXAMPLE 5

Plastisol B was spread coated onto a substrate to a thickness of 1 mm by knife over roller. The substrate was a 2 m width cellulose/polyester support (Dexter 555:030) reinforced with a Kirson '5×5' 32 tex glass crennette moving at a rate of 7 metres/minute. Particles of coloured quartz of a size of 1.2-1.8 mm were then scattered on to the surface of the plastisol at a rate of 500 $g/m^2$. The system was then passed into a convection oven where it was exposed to 160° C. for 2 minutes. The system was then passed through a series of cooling rollers before it was over coated with more plastisol containing 10% by weight of aluminium oxide particles size F40 (FEPA Standard 42-GB-1984 measurement) to a total thickness of 2 mm by knife over bed.

Particles of PVC chip B were then scattered onto the surface of the plastisol at a rate of 50 $g/m^2$. The coated web was then passed under a 50 kW medium wave infra red heater (width 2.5 m; length 1 m). The heater was positioned at a height of about 10 cm above the web. The power output of the heater was adjusted so that the surface of the plastisol as it exited the infra red zone was just solidified to the touch. The power was then reduced so that the surface of the plastisol was not quite solidified ('gelled'), but had very high viscosity.

An epoxy based clear coating powder D (average particle size 50 μm) was then applied to the surface at a rate of 80±30 $gm^{-2}$ using a scatter powder coating application system. Particles of silicon carbide size F40 (FEPA Standard 42-GB-1984 measurement) were then scattered onto the surface at a rate of 100 $gm^{-2}$. The system was then passed in to a convection oven where it was exposed to 190° C. for 2.5 minutes before being embossed, cooled and wound up for subsequent trimming to size.

EXAMPLE 6

Plastisol A was spread coated on a substrate to a thickness of 2 mm by knife over roller. The substrate was a 2 m width cellulose/polyester support (Dexter 555:030) reinforced with a Kirson '3×2' 32 tex glass crennette moving at a rate of 3 metre/minute. Particles of coloured quartz of a size of 1.2-1.8 mm were then scattered on to the surface of the plastisol at a rate of 500 $g/m^2$. The coated web was then passed under a 50 kW medium wave infra red heater (width 2.5 m; length 1 m). The heater was positioned at a height of 10 cm above the web. The power output of the heater was adjusted so that the surface of the plastisol as it exited the infra red zone was fully solidified ('gelled') to the touch.

An acrylic based clear coating powder F, was then applied to the surface at a rate of 80±30 $g/m^2$ using a scatter powder coating application system. Particles of silicon carbide size F40 (FEPA Standard 42-GB-1984 measurement) were then scattered on to the surface at the rate of 100 $g/m^2$. The system was then passed in to a convection oven where it was exposed to 190° C. for 2 minutes before being embossed, cooled and wound up for subsequent trimming to size.

EXAMPLE 7

Plastisol B was spread coated on a substrate to a thickness of 2 mm by knife over roller. The substrate was a 0.5 m width cellulose/polyester support (Dexter 555:030) reinforced with a Kirson '4×4' 68 tex glass crennette, moving at a rate of 1.5 metre/minute. Particles of coloured quartz of a size of 1.2-1.8 mm were then scattered on to the surface of the plastisol at a nominal rate of 500 $g/m^2$. The coated web was then passed under a 4 kW medium wave infra red heater (width 0.6 m; length 0.4 m). The latter was positioned at a height of about 5 cm above the web. The power output was adjusted so that the surface of the plastisol as it exited the infra red zone was not quite solidified ('gelled') to the touch.

A radiation curable polyester powder coating E (average particle size 50 μm) was then applied to the surface at a rate of 80±30 g/m$^2$ using a scatter powder coating application system. Particles of silicon carbide size F24 (FEPA Standard 42-GB-1984 measured) were then scattered onto the surface at the rate of 100 g/m$^2$. The system was then passed in to a convection oven where it was exposed to 185° C. for 2 minutes. It was immediately embossed and irradiated by being passed under a Honle UVAPRINT 360 medium pressure mercury uv lamp positioned 3 cm above the web before being cooled.

EXAMPLE 8

Plastisol A was spread coated on a substrate to a thickness of 2 mm by knife over roller. The substrate was a 0.5 m width cellulose/polyester support (Dexter 555:030) reinforced with a Kirson '4×4' 68 tex glass crennette moving at a rate of 4 metres/minute. Particles of coloured quartz of a size of 1.2-1.8 mm were then scattered on to the surface of the plastisol at a rate of 400 g/m$^2$. The coated web was then passed under a 4 kW medium wave infra red heater (width 0.6 m; length 0.4 m). The latter was positioned at a height of about 5 cm above the web. The power output of the heater was adjusted so that the surface of the plastisol as it exited the infra red zone was not quite solidified ('gelled') to the touch.

A polyester powder coating C (average particle size about 50 μm) was then applied to the surface at a rate of 80±30 g/m$^2$ using a scatter powder coating application system. Particles of silicon carbide size F24 (FEPA Standard 42-GB-1984 measurement) were then scattered on to the surface at a rate of 100 g/m$^2$. The system was then passed in to a convection oven where it was exposed to 160° C. for 2 minutes before being embossed, and cooled. Further clear powder C was then applied at a rate of 80±30 g/ml using a scatter powder coating application system. The system was then passed in to a convection oven where it is exposed to 200° C. for 3 minutes before being embossed, and cooled.

EXAMPLE 9

A sample of the flooring material according to the invention was independently tested for dirt pick up using Draft International Standard Protocol ISO/DIS11378-2a. A first comparative sample of a flooring material product including a base layer of PVC, a non-PVC coating layer and particulate material, which was prepared by a method which omits the partial curing step (b) of the method of the invention, and a second comparative sample of a flooring material product including a base layer of PVC and particulate material were tested in comparison using the same protocol.

The colour of each sample was first measured using a Chroma Meter II reflectance spectrometer whilst the samples were illuminated with a pulsed Xenon arc lamp (diffuse illumination) and D65 lighting (standard artificial daylight). The method involved lining the walls of the drum of a Hexapod tumble tester with the samples. 250 g of soiled polymer pellets and 1 kg of chrome alloy steel balls were put in the drum and the tumble tester was operated for half an hour. The colour of each sample was measured again using the same spectrometer and the colour difference was determined.

The colour difference was lowest for the flooring material according to the invention and highest for the first comparative sample. Therefore it is clear that the flooring material of the invention is advantageous as it has a lower rate of dirt pick up compared to known flooring materials.

The invention claimed is:

1. A flooring material including a base portion, a coating portion being positioned in contact with an upper surface of the base portion and creating an upper surface of the flooring material, wherein the base portion includes a PVC plastisol material, wherein the coating portion is substantially free from contaminants from the base which decrease the stain resistance of the coating portion, wherein there is interpenetration between the coating portion and the base portion to an extent necessary to bond the two portions together and prevent migration from the base portion to the coating portion of contaminants that increase staining of the coating portion, and wherein the coating portion includes a first particulate material which at least partially penetrates the base portion and is proud from the upper surface of the flooring material, wherein the coating portion includes an acrylic polymer and PvdF.

2. A flooring material as in claim 1 wherein the base portion and the coating portion are formed from the same or different plastics material, preferably different plastics material.

3. A flooring material as claimed in claim 1 wherein the coating portion is substantially free from a thermo-setting polymer or copolymer.

4. A flooring material as claimed in claim 1 in which the contaminants are contaminants which are capable of diffusing from the base portion into the coating portion during manufacture of the flooring material.

5. A flooring material as claimed in claim 1 in which the contaminants are a plasticizer, a thermal stabilizer, a rheology or viscosity modifier and/or a carrier liquid for an additive to the base portion.

* * * * *